US008511275B2

(12) United States Patent
Nistler et al.

(10) Patent No.: US 8,511,275 B2
(45) Date of Patent: Aug. 20, 2013

(54) METHOD AND SYSTEM FOR A COMMON RAIL FUEL SYSTEM

(75) Inventors: Paul Gerard Nistler, Erie, PA (US); Shawn Gallagher, Erie, PA (US); Neil Blythe, Erie, PA (US); Luke Henry, Erie, PA (US)

(73) Assignee: General Electric Company, Schenectady, NY (US)

( * ) Notice: Subject to any disclaimer, the term of this patent is extended or adjusted under 35 U.S.C. 154(b) by 362 days.

(21) Appl. No.: 12/896,377

(22) Filed: Oct. 1, 2010

(65) Prior Publication Data

US 2012/0080010 A1 Apr. 5, 2012

(51) Int. Cl.
*F02B 77/08* (2006.01)

(52) U.S. Cl.
USPC ..... 123/198 D; 123/458

(58) Field of Classification Search
USPC ..... 123/456, 458, 514, 198 D, 198 DB; 73/114.38, 114.43
See application file for complete search history.

(56) References Cited

U.S. PATENT DOCUMENTS

| | | | | |
|---|---|---|---|---|
| 5,241,933 | A | 9/1993 | Morikawa | |
| 5,708,202 | A | 1/1998 | Augustin et al. | |
| 5,715,786 | A | 2/1998 | Seiberth | |
| 6,024,064 | A * | 2/2000 | Kato et al. | 123/179.17 |
| 6,422,265 | B1 | 7/2002 | Beyer et al. | |
| 6,990,855 | B2 * | 1/2006 | Tuken et al. | 73/114.51 |
| 7,392,792 | B2 * | 7/2008 | Puckett | 123/456 |
| 7,987,704 | B2 * | 8/2011 | Lucido et al. | 73/114.43 |
| 2008/0041331 | A1 | 2/2008 | Puckett | |

FOREIGN PATENT DOCUMENTS

| | | | |
|---|---|---|---|
| DE | 19520300 | A1 | 12/1996 |
| DE | 19547647 | A1 | 6/1997 |
| DE | 19604552 | A1 | 8/1997 |
| EP | 0976921 | A2 * | 2/2000 |
| EP | 1832737 | A2 | 9/2007 |
| EP | 1832737 | A2 * | 12/2007 |

OTHER PUBLICATIONS

Search Report and Written Opinion from corresponding PCT Application No. PCT/US2010/057589 dated Oct. 5, 2011.

* cited by examiner

*Primary Examiner* — Stephen K Cronin
*Assistant Examiner* — Carl Staubach
(74) *Attorney, Agent, or Firm* — John A. Kramer; GE Global Patent Operation

(57) ABSTRACT

In one embodiment, a common rail fuel system for an engine of a vehicle, such as a locomotive, comprises a higher-pressure fuel sub-system and a lower-pressure fuel sub-system, wherein a pressure limiting valve, is in fluid communication with to the higher-pressure fuel sub-system to relieve excess pressure. In a condition where pressure of the higher-pressure fuel sub-system is below a desired and expected threshold, it is possible that the pressure limiting valve is open. An example method is provided to close the pressure limiting valve and determine if opening of the pressure limiting valve is the cause of the pressure being below the threshold or if a leak is present in the common rail fuel system. In this manner, unnecessary disabling of the engine is avoided and, if a leak is present, the leaking sub-system is identified.

23 Claims, 4 Drawing Sheets

METHOD AND SYSTEM FOR A COMMON RAIL FUEL SYSTEM

FIELD

The subject matter disclosed herein relates to a method and a system for controlling a common rail fuel system in a vehicle, such as a rail vehicle.

BACKGROUND

Vehicles, such as rail vehicles, include power sources, such as diesel engines. In some vehicles, fuel is provided to the diesel engine by a common rail fuel system. One type of common rail fuel system comprises a low-pressure fuel pump in fluid communication with a high-pressure fuel pump, and a fuel rail in fluid communication with the high-pressure fuel pump and further in fluid communication with at least one engine cylinder. The low-pressure fuel pump delivers fuel from a fuel supply to the high-pressure fuel pump through a conduit, wherein an inlet metering valve is disposed. The high-pressure fuel pump pressurizes fuel for delivery through the fuel rail. Fuel travels through the fuel rail to at least one fuel injector, and ultimately to at least one engine cylinder. Within the at least one engine cylinder, fuel is burned to provide power to the vehicle.

Further, the higher-pressure sub-system of the common rail fuel system includes a pressure limiting valve for relieving pressure. The pressure limiting valve may redirect fuel away from the fuel rail, to the fuel supply, during a high-pressure surge (excess pressure). During the high-pressure surge, the pressure limiting valve will open in order to decrease the rail pressure. The pressure limiting valve closes when the rail pressure returns to a lower pressure than the rail pressure that originally triggered the pressure limiting valve opening. In some conditions, the rail pressure may decrease to a sufficient level for operation, yet the pressure limiting valve may remain open. In such a condition, fuel is continuously redirected to the fuel supply, resulting in decreased fuel supply pressure to the engine and possibly decreased power provided to the vehicle. Additionally, a persistently low rail pressure may signal to an Engine control unit that an external leak is present. In this example, the Engine control unit will command the engine to be disabled in order to mitigate possible effects of the presumed external leak, such as engine performance degradation. However, in fact, the shutdown may be unnecessary as the pressure limiting valve is the cause of the low rail pressure, not an external leak.

BRIEF DESCRIPTION OF THE INVENTION

Accordingly, to address the above issues, various embodiments for a common rail fuel system and various methods of controlling the common rail fuel system are described herein. For example, in one embodiment, a method for controlling a fuel system of an engine including a lower-pressure fuel sub-system and a higher-pressure fuel sub-system, with a pressure limiting valve in fluid communication with the higher-pressure sub-system for relieving excess pressure in the higher-pressure fuel sub-system by returning fuel to the lower-pressure fuel sub-system, comprising, in response to fuel rail pressure in the higher-pressure fuel sub-system falling below a desired operating pressure during engine operation, first adjusting the fuel system to temporarily further reduce fuel rail pressure in the higher-pressure fuel sub-system to reset the pressure limiting valve, and after first adjusting the fuel system to reduce fuel rail pressure in the higher-pressure fuel sub-system, further adjusting the fuel system to increase fuel rail pressure in the higher-pressure fuel sub-system, and then if the fuel rail pressure of the higher-pressure fuel sub-system persists below the desired operating pressure, disabling the engine. Thus, in carrying out the method, an attempt is made to return the rail pressure to a normal operating pressure instead of immediately disabling the engine, thereby reducing occurrences of unnecessary shutdowns.

This brief description is provided to introduce a selection of concepts in a simplified form that are further described herein. This brief description is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure. Also, the inventors herein have recognized any identified issues and corresponding solutions.

BRIEF DESCRIPTION OF THE DRAWINGS

The present invention will be better understood from reading the following description of non-limiting embodiments, with reference to the attached drawings, wherein below.

DETAILED DESCRIPTION

Figure 1:
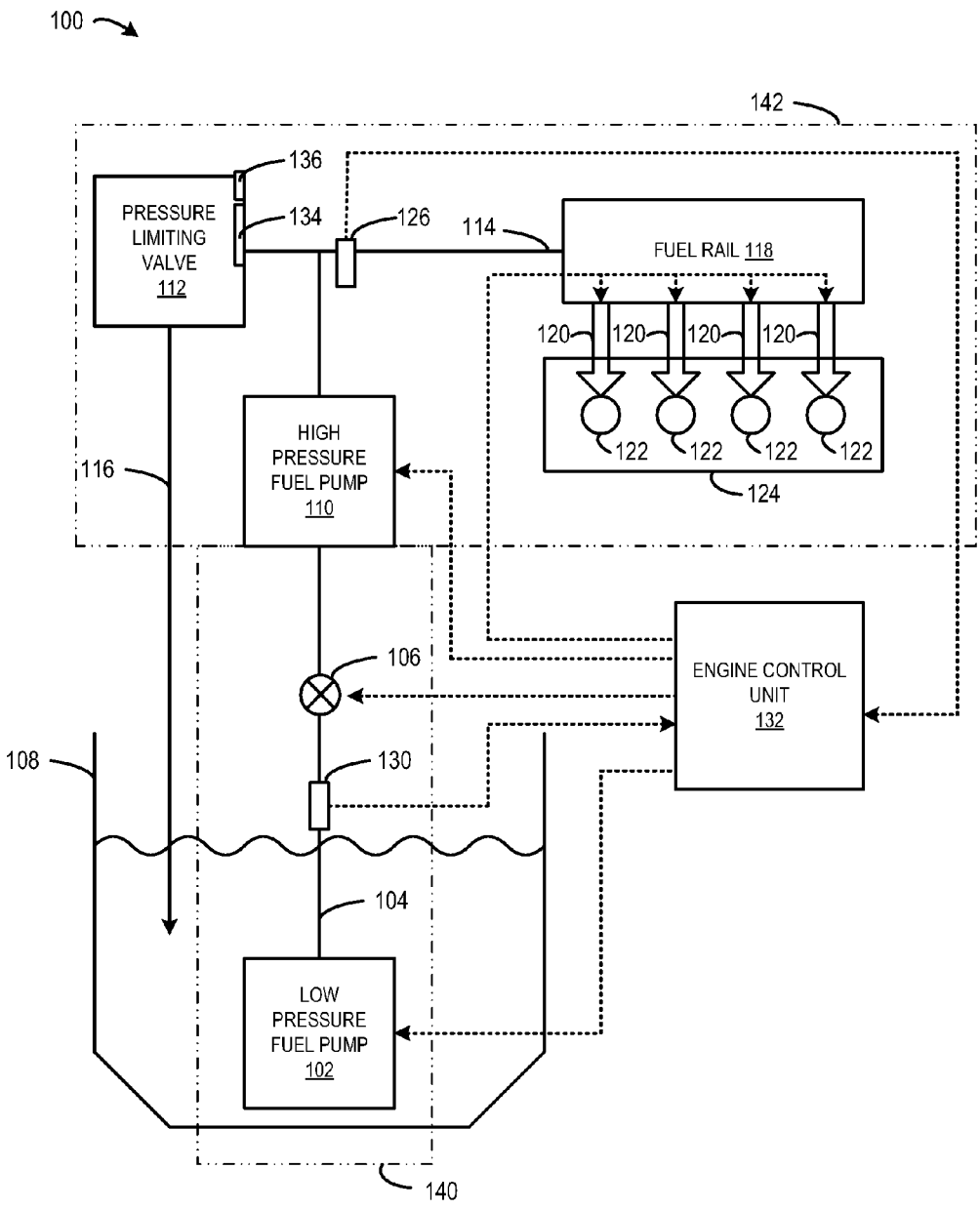
FIG. 1 shows an example embodiment of an off-highway vehicle common rail fuel system.
Figure 2:
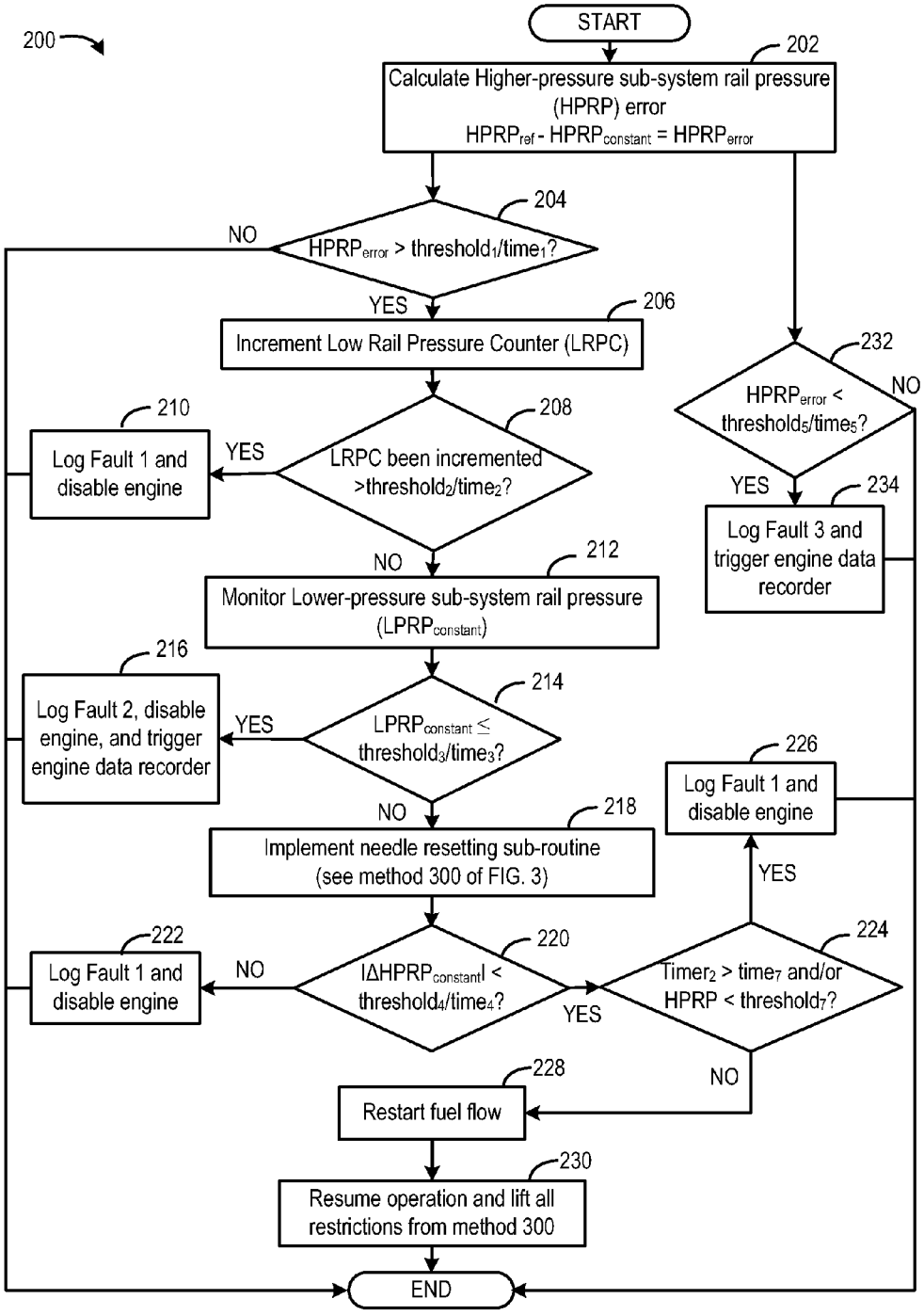
FIG. 2 shows an example high level flow chart of a routine for controlling the common rail fuel system of FIG. 1.
Figure 3:
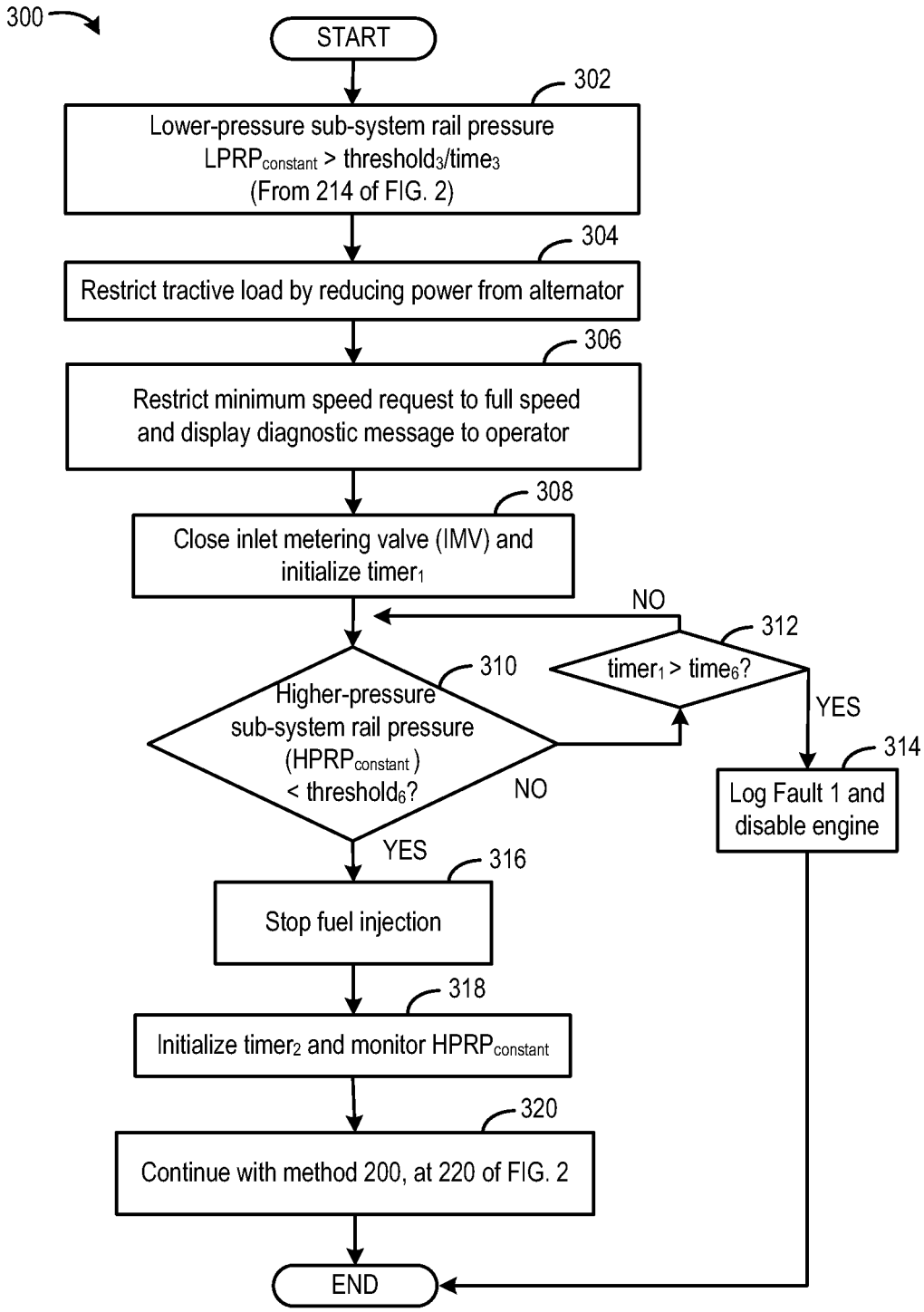
FIG. 3 shows an example high level flow chart of a sub-routine within the routine of FIG. 2 for closing the pressure limiting valve of FIG. 1.
Figure 4:
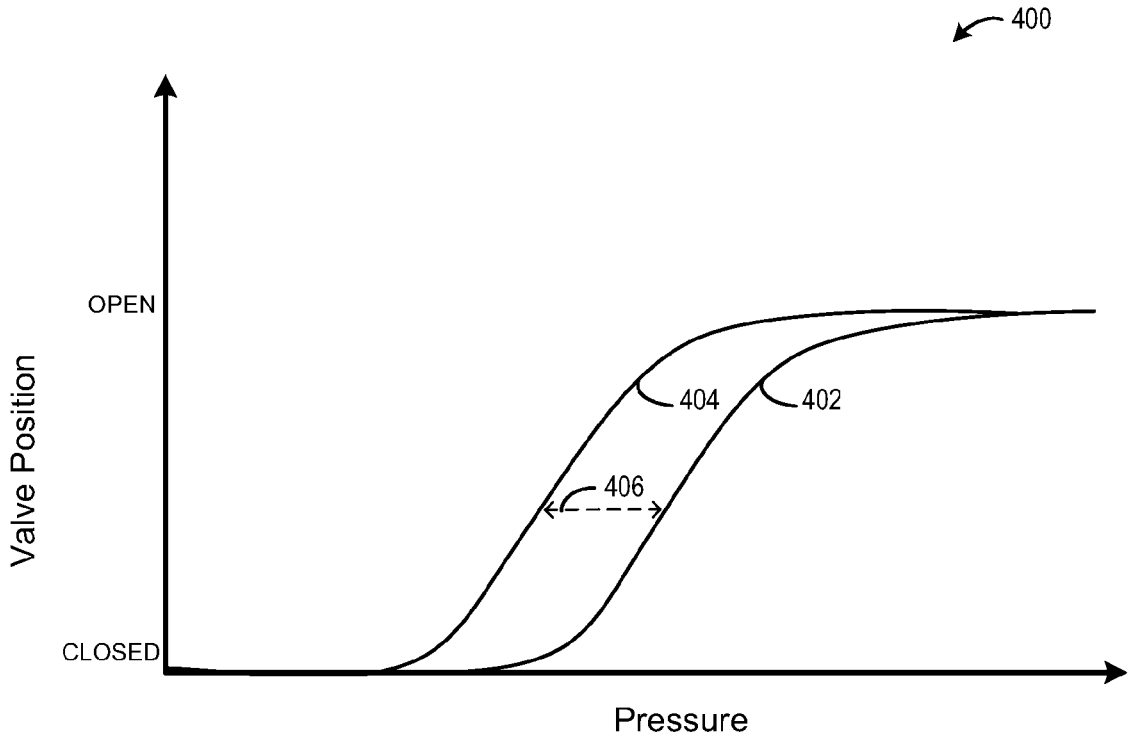
FIG. 4 shows an example hysteresis curve for the pressure limiting valve of FIG. 1.

The present application relates to vehicles, such as rail vehicles, that include an engine (such as a diesel engine) where fuel is provided to the engine through a common rail fuel system (CRS). One embodiment of a CRS including a pressure limiting valve (PLV) is shown in FIG. 1. Example methods for controlling the CRS of FIG. 1 are shown in FIGS. 2-3. Additionally, an example hysteresis curve for the PLV of FIG. 1 is shown in FIG. 4.

In one embodiment, an engine control unit (ECU) is configured to carry out a method for controlling a CRS. If the engine experiences a high-pressure surge, for example if the rail pressure (RP) increases to greater than or equal to 190 MPa, a pressure limiting valve (PLV) will open and in some conditions can remain open even after the RP has decreased to a desired pressure. For example, the RP may decrease to 60-180 MPa, while the threshold required to close the PLV is 50 MPa. In such conditions, the example method enables the ECU to close an open PLV by temporarily decreasing the RP below the threshold required to close the PLV. In this manner, the ECU first implements the routine to close the PLV and then restarts fuel flow to attempt to return the RP to a normal operating pressure instead of immediately disabling the engine. Thus, occurrences of unnecessary shutdowns are reduced.

In one example case, the PLV is open even after the RP has decreased to a desired pressure, for example when the engine experiences a high-pressure surge and then decreases RP to 700 bar, and no unintended external leak exists. In this example, the RP and engine operation may return to a desired and normal state after the ECU reduces rail pressure to reset the PLV. In an alternative case, wherein an unintended external leak does exist and/or the PLV is not open, the RP may remain below the threshold required to close the PLV even after the ECU carries out the example method. In this alternative case, the ECU may then command that the engine is disabled until servicing in order to mitigate possible effects of the leak. In both examples, the RP level can be determined by monitoring a change in constant RP when both injection and pumping have ceased. Further, the ECU may be configured to determine whether the leak is in the lower-pressure sub-system of the CRS or in the higher-pressure sub-system of the CRS based on various operating parameters.

In the embodiment of FIG. 1, the CRS includes a low-pressure fuel pump which pumps fuel from a fuel supply, a high-pressure fuel pump which receives fuel from the low-pressure fuel pump and pressurizes fuel for delivery through a fuel rail to fuel injectors. The fuel injectors then deliver the pressurized fuel to engine cylinders. Within the engine cylinders, fuel is burned to provide power to the vehicle.

The region of the CRS upstream of the high-pressure fuel pump is substantially a lower-pressure subsystem of the CRS, while the region of the CRS downstream of the high-pressure fuel pump is substantially a higher-pressure sub-system of the CRS. A RP can be measured and monitored on each of the higher-pressure sub-system and the lower-pressure sub-system of the CRS by pressure sensors.

As depicted in FIG. 1, the example CRS further includes an inlet metering valve (IMV) disposed between the low-pressure fuel pump and the high-pressure fuel pump. A degree of opening and closing of the IMV may regulate transfer of fuel from the low-pressure fuel pump to the high-pressure fuel pump. Also depicted in FIG. 1, a PLV is in fluid communication with the high-pressure fuel pump. The PLV is normally closed, but will open during a high-pressure surge to relieve fuel pressure and prevent damage to the engine. During a high-pressure surge, the PLV redirects fuel back to the fuel supply. When the RP decreases sufficiently, the PLV closes.

Under some conditions, the PLV can remain open even after the RP has decreased to a desired or expected operating pressure. In such conditions, fuel is continuously redirected away from the engine to the fuel supply, though pressure relief of the CRS is no longer needed. This can occur because the pressure required to open the valve is greater than the pressure required to close the valve, resulting in a hysteresis of the PLV (shown in the hysteresis curve of FIG. 4). In this condition, even if the RP on the higher-pressure sub-system decreases to a pressure sufficient for operation of the CRS and the engine, the PLV remains open so that the RP remains relatively low. An ECU, which receives RP readings from the pressure sensors, interprets this low RP as a possible leak in the CRS.

In this example embodiment of a CRS, the ECU is configured to carry out a routine to determine if the RP is lower than a normal operating RP, such as the method shown in FIG. 2. The ECU can assess for the presence of a leak by determining CRS parameters including a higher-pressure sub-system rail pressure error, the number of times a low rail pressure counter is incremented, a lower-pressure sub-system rail pressure constant, and an absolute value of a rate of change of RP. Each parameter may be compared to a predetermined threshold over a predetermined time period. Predetermined thresholds and predetermined time periods may be variable based on other engine parameters. Additionally, the ECU is configured to determine if the low RP on the higher-pressure sub-system of the CRS is due to the IMV being stuck closed. Further, the ECU can determine that a high RP is due the IMV being stuck open.

The method of FIG. 2 further shows that the region of the leak may be identified (either of the lower-pressure sub-system or the higher-pressure sub-system). If a leak in the higher-pressure sub-system is suspected, the ECU will first implement a sub-routine (such as the method shown in FIG. 3) to decrease the RP below a threshold required to reset the needle of the PLV. After the sub-routine, the ECU monitors the constant RP and determines if the absolute value of the RP rate of change is less than or greater than or equal to a threshold over a predetermined time. If the absolute value of the RP rate change is greater than the threshold, then the ECU determines that an external leak is likely present and disabling of the engine is initiated. In alternate embodiments, the RP may be measured directly and/or an RP error may be calculated and compared to a predetermined standard.

FIG. 1 includes a block diagram of a CRS 100 for an engine of a vehicle, such as a rail vehicle. In one example, the rail vehicle is a locomotive, however, in alternate embodiments, the engine may be in another type of off-highway vehicle, stationary power plant, marine vessel, or others. Liquid fuel is stored in a fuel tank 108. A low-pressure fuel pump 102 is in fluid communication with the fuel tank 108. In this embodiment, the low-pressure fuel pump 102 is disposed inside of the fuel tank 108 and can be immersed below the liquid fuel level. In alternate embodiments, the low-pressure fuel pump may be coupled to the outside of the fuel tank and pump fuel through a suction device. Operation of the low-pressure fuel pump 102 is regulated by an ECU 132.

Liquid fuel is pumped by the low-pressure fuel pump 102 from the fuel tank 108 to a high-pressure fuel pump 110 through a conduit 104. An IMV 106 is disposed in the conduit 104 and regulates fuel flow through the conduit 104. The IMV 106 may be a solenoid valve, opening and closing of which is regulated by the ECU 132. During operation of the vehicle, the IMV 106 is adjusted to meter fuel based on operating condition, and during at least some conditions may be at least partially open.

The high-pressure fuel pump 110 pressurizes fuel and delivers fuel to a fuel rail 118 through a conduit 114. A plurality of fuel injectors 120 are in fluid communication with the fuel rail 118. Each of the plurality of fuel injectors 120 delivers fuel to one of a plurality of engine cylinders 122 in an engine 124. Fuel is burned in the plurality of engine cylinders 122 to provide power to the vehicle through an alternator and traction motors, for example. Operation of the plurality of fuel injectors 120 is regulated by the ECU 132. In the embodiment of FIG. 1, the engine 124 includes four fuel injectors and four engine cylinders. In alternate embodiments more or fewer fuel injectors and engine cylinders can be included in the engine.

Components of the CRS 100 which are upstream of the high-pressure fuel pump 110 are in a lower-pressure sub-system 140 of the CRS 100. Components of the CRS 100 which are downstream of the high-pressure fuel pump 110 are in a higher-pressure sub-system 142 of the CRS 100. RP of the lower-pressure sub-system 140 may be measured by a pressure sensor 130. The lower-pressure sub-system 140 may have a normal operating RP range during operation of the engine, e.g., a range from 0.45 MPa to 0.69 MPa during operation of the engine. RP of the higher-pressure sub-system 142 may be measured by a pressure sensor 126. The higher-pressure sub-system 142 may have a normal operating RP range during operation of the engine, e.g., a range from 70 MPa to 160 MPa bar during operation of the engine.

RP signals from each of the pressure sensor 130 and the pressure sensor 126 are communicated to the ECU 132. In this example embodiment, the pressure sensor 130 is disposed in the conduit 104 and the pressure sensor 126 is disposed in the conduit 114. In alternate embodiments, the pressure sensor 130 may be in fluid communication with to an outlet of the low-pressure fuel pump 102 and/or the pressure sensor 126 may be in fluid communication with an outlet of the high-pressure fuel pump 110.

A PLV 112 is in fluid communication with the conduit 114 and is in fluid communication with the high-pressure fuel pump 110 and fuel rail 118. In the example embodiment, the PLV 112 includes a needle 134, which blocks an inlet of the PLV 112. The needle 134 is held in place by a spring 136, applying a biasing force on the needle 134. In an alternate embodiment, the needle may be secured by other structures that provide a biasing force, such as a tension arm. The PLV 112 is provided in the CRS 100 to relieve high-pressure surges (excess pressure) that may occur in the higher-pressure sub-system 142. For example, as stated above, a desired and expected operating RP in the higher-pressure side may range from 70 to 160 MPa, which, in one embodiment, is a normal operating RP of the higher-pressure sub-system. As one example, a high-pressure surge can raise the RP to greater than or equal to 195 MPa.

During a high-pressure surge, an upward force of the pressurized fuel overcomes the biasing force of the spring 136 holding the needle 134. In this condition, the needle 134 is displaced and moved upward as the spring 136 is compressed, such that the PLV 112 opens. An RP required to displace the needle 134 may range from 195 to 205 MPa. With the PLV 112 open, liquid fuel is redirected from the conduit 114 to the fuel tank 108 through a conduit 116. The configuration and geometry of the needle 134 and the spring 136 are such that when the RP decreases a certain amount, e.g., to 35-65 MPa, the needle 134 is repositioned and closes the PLV 112.

A difference between a RP required to open the PLV 112 and a RP required to close the PLV 112 is represented by a hysteresis curve 400 of FIG. 4. In the hysteresis curve 400, a line 404 represents an example RP that allows the PLV 112 to close and a line 402 represents an example RP that allows the PLV 112 to open. A difference between the lines 402 and 404 is represented by a dashed double arrow 406. A distance of the dashed double arrow 406 is a hysteresis of the movement of the needle 134, or a lag in response to changes in pressure. Therefore, in some instances, RP decreases to a desired or expected operating pressure, but the PLV 112 remains open. Liquid fuel may continue to flow through the PLV 112 to the fuel tank 108 until the needle 134 is repositioned and blocks fuel flow. As such, the fuel rail 118, the plurality of fuel injectors 120, and the plurality of engine cylinders 122 can receive a decreased amount of fuel and the engine 124 may produce less power to drive the OHV. Consequently, engine performance is degraded. In other words, even though the PLV is open and the fuel injectors continue to operate, the high-pressure fuel pump provides sufficient fuel flow to maintain sufficient injection pressure for engine operation, albeit at less than maximum power output, but high enough that the PLV does not close on its own. In this situation, the pressure sensor 126 signals to the ECU 132 that the RP is lower than the desired or expected operating pressure, indicating that an external leak may be present.

To mitigate the effects of an external leak, the ECU 132 can command the engine to be disabled until serviced. However, in some instances, as described above, a decrease in RP is caused by the PLV 112 being open and a disabling of the engine is unnecessary. Thus, in response to the detection of low RP, the ECU may implement a routine, such as shown in FIGS. 2-3, to recover the normal operating RP by creating conditions where the PLV 112 can close if it is open. In other words, in a condition where excess pressure in the higher-pressure fuel sub-system is relieved by returning fuel to the lower-pressure fuel sub-system through the PLV, the PLV may remain open for a duration which is longer than a desired duration. In such a condition, the PLV can be reset to a closed state by temporarily reducing pressure in the higher-pressure fuel sub-system.

If the normal operating RP is recovered or a change in RP is less than a threshold over a predetermined time period after carrying out a PLV resetting sub-routine, the ECU 132 returns the vehicle to normal operating conditions without disabling engine operation. In comparison, if the normal operating RP is not recovered or a change in RP is greater than a threshold over a predetermined time period, the ECU 132 proceeds with engine disabling. The ECU 132 also determines whether the external leak is likely present in the lower-pressure sub-system 140 or the higher-pressure sub-system 142, or if the IMV is sticking, and logs a corresponding error/fault. Thus, by disabling the engine when the RP remains low after implementing the PLV resetting sub-routine, unnecessary disabling of the engine is reduced and engine performance is improved.

Prior to initiating a method 200 to analyze and control RP, initial enabling conditions are met, such as the RPM is greater than a RPM threshold. An example RPM threshold is 450 RPM for 30 seconds. As depicted in FIG. 2, a method 200 begins at 202 wherein the higher-pressure sub-system RP (HPRP) error is calculated through the following equation: $HPRP_{ref}-HPRP_{constant}=HPRP_{error}$. $HPRP_{ref}$ is a predetermined standard operating RP depending on the current operating conditions for the CRS. An example of $HPRP_{ref}$ is 160 MPa at full load. $HPRP_{constant}$ is the RP which is directly measured by pressure sensor 126. In alternate embodiments, the HPRP may be determined from a maximum pressure signal, a minimum pressure signal, or an average pressure signal. In 204, it is determined whether $HPRP_{error}$ is greater than or equal to $threshold_1/time_1$. Both of $threshold_1$ and $time_1$ are predetermined standards which indicate that the RP is below the normal operating pressure for the CRS. An example of $threshold_1$ and $time_1$ are 30 MPa for 15 sec, respectively.

In an alternate embodiment, HPRP error may be a model-based approach where the size of a leak is estimated based on a conservation of mass model of the CRS. In this alternate embodiment, fuel flow may be determined from an IMV duty cycle and fuel out may be determined from injection timing. Therefore, a modeled leak of additional fuel out may be estimated from the measured RP.

In a condition wherein $HPRP_{error}$ is less than $threshold_1/time_1$, the ECU determines that no external leak is present and/or the PLV is not open. The ECU continues to monitor the RP and $HPRP_{error}$. In a condition wherein $HPRP_{error}$ is greater than or equal to $threshold_1/time_1$, the ECU increments a low rail pressure counter (LRPC) in 206. In 208, the ECU determines if the LRPC has been incremented more than a $threshold_2$ over a $time_2$. An example of $threshold_2$ and $time_2$ are 5 occurrences of incrementing the LRPC over one hour. In a condition wherein the occurrences of incrementing the LRPC are greater than $threshold_2$ over $time_2$, as shown in 210, the ECU logs a Fault 1 and disables the engine.

In a condition wherein the occurrences of incrementing the LRPC are less than $threshold_2$ over $time_2$, as shown in 212, the ECU monitors the lower-pressure sub-system RP ($LPRP_{constant}$). In 214, it is determined whether $LPRP_{constant}$ is less than or equal to a $threshold_3$ over $time_3$. An example of $threshold_3$ and $time_3$ are 0.28 MPa and 5 seconds, respectively. In a condition wherein the $LPRP_{constant}$ is less than or equal to $threshold_3$ over $time_3$, a Fault 2 is logged, the engine is disabled, and an engine data recorder is triggered, as in 216. In a condition wherein the $LRPR_{constant}$ is greater than a $threshold_3$ over $time_3$, as in 218, the ECU implements a needle resetting sub-routine, including a method 300 shown in FIG. 3, to decrease the RP to a level sufficient to reset the needle of the PLV and cease the return fuel flow.

The method 300 is initiated following a "NO" to 214 from FIG. 2, wherein the $LRPR_{constant}$ is greater than a $threshold_3$ over $time_3$, as in 302. At 304, the ECU restricts or reduces power from an engine alternator (not shown) to drop the tractive load on the engine so that the engine may operate with significantly reduced fuel flow and at lower speeds, if desired. At 306, the minimum speed request of full speed is set, for example 1500 RPM, to ensure the engine is not coasting down, and a diagnostic message is signaled to the operator. The diagnostic message may include a waiting command, such as "Please wait, Diagnostics in Process". Alternatively, the tractive load may remain applied to the engine and the minimum speed request may not be increased to full speed while carrying out method 300. Additionally, the diagnostic code may be signaled by other means, such as other visual and/or auditory signals.

At 308, the IMV is commanded to close in order to stop the flow of fuel from the low-pressure fuel pump to the high-pressure fuel pump, even though the low-pressure fuel pump continues to operate. Alternatively, operation of the low-pressure fuel pump may be stopped or reduced to decrease fuel flow. Additionally in 308, a first timer ($timer_1$) is initiated.

The ECU then monitors the $HPRP_{constant}$, until the $HPRP_{constant}$ is less than $threshold_6$, at 310. An example of $threshold_6$ is 35 MPa. If $HPRP_{constant}$ is greater than $threshold_6$ and the $timer_1$ is greater than a predetermined $time_6$ (in 312), then the ECU logs a Fault 1 and disables the engine, as in 314. An example of $time_6$ is 3 seconds. If $timer_1$ has not passed $time_6$ the routine is delayed and cycles back to 310. If the $HPRP_{constant}$ is less than $threshold_6$, then the ECU commands fuel injection to stop at 316, substantially stopping fuel flow, and a second timer ($timer_2$) is initialized and $HPRP_{constant}$ is monitored at 318. In an alternate embodiment, stopping of fuel injection may occur at the same time as closing the IMV. Method 300 then ends and continues to 220 of method 200 at 320.

At 220 of FIG. 2, the ECU determines the absolute value of the change in $HPRP_{constant}$ is calculated, and if greater than a $threshold_4$ over $time_4$ the ECU logs a Fault 1 and disables the engine, as in 222. In one embodiment, $threshold_4$ over $time_4$ is 5 MPa/200 ms. In 224, the ECU further determines if the duration of $timer_2$ is greater than time and/or if HPRP is less than a $threshold_7$. If one or both of the conditions of 224 are met, then the ECU logs a Fault 1 and disables the engine at 226. In one embodiment, $time_7$ is 1 s and $threshold_7$ is 25 MPa. If the absolute value of the change in $HRPR_{constant}$ is less than a $threshold_4$ over $time_4$, $timer_2$ is less than $time_7$, and HPRP is greater than $threshold_7$, fuel flow is restarted in 228 and engine operation is resumed and restrictions from method 300 are lifted in 230. In this case, the needle re-setting sub-routine was successful, and the PLV opening was likely the cause of the original low RP ($HRPR_{error}$<$threshold_1/time_1$ at 204). Thus, an unnecessary engine shutdown was avoided. In some embodiments $threshold_4/time_4$ may be approximately 0, and thus the calculation of 220 may be considered a zero slope analysis. In an alternate embodiment, the CRS may be manufactured with small leak orifices to automatically bleed pressure so that maintenance can be performed. In this alternate embodiment, the $threshold_4/time_4$ may change over time as some pressure loss is expected through the small leak orifices. In another alternate embodiment, fuel flow may be restarted after method 300 is complete and it may be again determined if $HPRP_{error}$ is greater than $threshold_1/time_1$. In this alternate embodiment, if the $HPRP_{error}$ is persistently high, then the ECU may log a Fault 1 and disable the engine, and if the $HPRP_{error}$ is within the normal and expected range, engine operation may resume.

Alternatively to the sequence shown in 204-230 of method 200, at 232 it can also be determined if $HPRP_{error}$ is less than a $threshold_5$ over $time_5$. In a condition wherein $HPRP_{error}$ is less than a $threshold_5$ over $time_5$, the higher-pressure sub-system has an RP that is above a desired operating pressure. Examples of $threshold_5$ and $time_5$ are −30 MPa and 30 seconds, respectively. If the $HPRP_{error}$ is less than the $threshold_5$ over $time_5$, then a Fault 3 is logged by the ECU and the engine data recorder is triggered at 234. If the $HPRP_{error}$ is greater than the $threshold_5$ over $time_5$, the routine ends.

In methods 200 and 300, Fault 1 may include a malfunction of the PLV, IMV, or high pressure fuel pump and/or a leak in the higher-pressure sub-system and/or fuel injectors. Fault 2 may include a leak in the lower-pressure sub-system and/or a malfunction of the low pressure fuel pump. Fault 3 may include a malfunction of the IMV, more specifically, the IMV being stuck open. An operator can access the error/fault log in order to determine where repairs can be made to the CRS. In one embodiment, the error/fault log is viewed in real time. In an alternate embodiment, the error/fault log may be accessed at a later time.

The example routine for controlling the example embodiment of a CRS has the advantage that when the ECU detects a low HPRP, the ECU does not immediately shut down the engine and halt operation of the OHV. Instead, the ECU first implements a sub-routine to stop fuel flow and lower the RP to a level sufficient for closing the PLV. The ECU then assesses if the problem of a low HPRP is resolved and restarts fuel flow. Further, if the problem is not resolved the ECU commands the engine to shut down, and additionally determine if the leak is present in either of the lower-pressure sub-system or the higher-pressure sub-system. As such, unnecessary engine shut downs are avoided. Additionally, when an external leak is present, the location of the leak is identified in order to speed repairs to the CRS.

Another embodiment relates to a method for controlling a fuel system of an engine. The method comprises measuring an RP in a higher-pressure fuel sub-system portion of the fuel system. (The fuel system comprises the higher-pressure fuel sub-system, a lower-pressure fuel sub-system, and a PLV for relieving excess pressure in the higher-pressure fuel sub-system, e.g., by shunting fuel from the higher-pressure fuel sub-system back to the lower-pressure fuel sub-system.) If the RP falls below a desired operating pressure during engine operation, the RP is reduced to reset the PLV. Subsequently, the RP is increased, and remedial action is taken (e.g., the engine disabled and/or a warning generated) if the RP persists below the desired operating pressure.

Elements referred to as "high-pressure" and "low-pressure" and "higher-pressure" and "lower-pressure" are relative to one another; thus, the pressure of a low- or lower-pressure system would be lower than the pressure of a high- or higher-pressure system, and the pressure of the high- or higher-pressure system would be higher than the pressure of the low- or lower-pressure system.

Though exemplary embodiments of the present invention are described herein with respect to locomotives and other vehicles, it is also applicable to powered systems generally, including stationary power generation systems. Towards this end, when discussing a specified mission, this includes a task or requirement to be performed by the powered system. In the case of stationary applications, e.g., a stationary power generation station having one or more generators, or a network of power generation stations, a specified mission may refer to an amount of wattage or other parameter or requirement to be satisfied by the power generation station(s), alone or in concert, and/or estimated or known opportunities to store excess power from a power grid, electrical bus, or the like. In the case of a diesel-fueled power generation system (e.g., a diesel generator system providing energy to an electrical energy storage system), operating conditions may include one or more of generator speed, load, fueling value, timing, etc.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to illustrate the parameters of the invention, they are by no means limiting and are exemplary embodiments, unless otherwise specified. Many other embodiments will be apparent to those of skill in the art upon reviewing the above description. Therefore, the scope of the invention should be determined with reference to the appended claims, along with the full scope of equivalents to which such claims are entitled.

In the appended claims, any instances of the terms "including" and "in which" are used as the plain-English equivalents of the respective terms "comprising" and "wherein." Moreover, in the following claims, the terms "first," "second," "third," "upper," "lower," "bottom," "top," etc. are used merely as labels, and are not intended to impose numerical or positional requirements on their objects. As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A method for controlling a fuel system of an engine, comprising:

measuring a fuel rail pressure in a higher-pressure fuel sub-system portion of the fuel system, the fuel system comprising the higher-pressure fuel sub-system, a lower-pressure fuel sub-system, and a pressure limiting valve for relieving excess pressure in the higher-pressure fuel sub-system;

reducing the fuel rail pressure below a threshold required to close the pressure limiting valve by stopping fuel flow in the higher-pressure fuel sub-system, responsive to the fuel rail pressure falling below a desired operating pressure, to reset the pressure limiting valve; and then stopping fuel injection from at least one fuel injector;

restarting fuel flow to the engine without disabling the engine if the fuel rail pressure recovers after resetting the pressure limiting valve; and disabling the engine if the fuel rail pressure persists below the desired operating pressure after resetting the pressure limiting valve.

2. The method of claim 1, wherein in response to the fuel rail pressure in the higher-pressure fuel sub-system falling below the desired operating pressure during engine operation, the fuel system is adjusted to temporarily further reduce fuel rail pressure in the higher-pressure fuel sub-system to reset the pressure limiting valve.

3. The method of claim 2, further comprising conducting a zero slope analysis, the zero slope analysis comprising determining an absolute value of a change in pressure in the higher-pressure fuel sub-system, the disabling the engine further based on the zero slope analysis.

4. The method of claim 3, wherein if the zero slope analysis is greater than a first threshold, over a first predetermined time, the engine is disabled.

5. The method of claim 4, wherein an inlet metering valve is disposed between the lower-pressure fuel sub-system and the higher-pressure fuel sub-system for regulating fuel flow between a low pressure pump in the lower-pressure fuel sub-system and a high pressure pump in the higher-pressure fuel sub-system, wherein first adjusting the fuel system to temporarily further reduce fuel rail pressure in the higher-pressure fuel sub-system includes restricting a tractive load from the engine and closing the inlet metering valve.

6. The method of claim 5, wherein after first adjusting the fuel system to temporarily further reduce fuel rail pressure in the higher-pressure fuel sub-system, the fuel injection from at least one fuel injector is stopped in order to conduct the zero slope analysis.

7. The method of claim 6, wherein after first adjusting the fuel system and conducting the zero slope analysis, wherein the zero slope analysis is less than the first threshold over the first predetermined time, the engine is further adjusted to increase fuel flow, including at least partially opening the inlet metering valve, restarting fuel injection from at least one fuel injector, and re-applying the tractive load.

8. The method of claim 4, wherein the higher-pressure fuel sub-system falling below the desired operating pressure during engine operation is determined by a higher-pressure sub-system fuel rail pressure error being greater than a second threshold over a second predetermined time.

9. The method of claim 8, wherein the higher-pressure sub-system fuel rail pressure error is calculated by subtracting an actual higher-pressure sub-system fuel rail pressure from a reference higher-pressure fuel sub-system fuel rail pressure, the reference based on current operating conditions of the engine.

10. The method of claim 9, wherein in response to the higher-pressure fuel sub-system rail pressure error being greater than the second threshold over the second predetermined time, a low rail pressure counter is incremented.

11. The method of claim 10, wherein in response to the low rail pressure counter being incremented more occurrences than a third threshold over a third predetermined time, a first fault is logged and the engine is disabled, the first fault indicating a malfunction in the higher-pressure fuel sub-system.

12. The method of claim 1, wherein in response to the low rail pressure counter being incremented less occurrences than the third threshold over the third predetermined time, a lower-pressure sub-system rail pressure is determined.

13. The method of claim 12, wherein in response to the lower-pressure sub-system rail pressure being less than or equal to a fourth threshold over a fourth predetermined time, a second fault is logged and the engine is disabled, the second fault indicating a malfunction in the lower-pressure fuel sub-system.

14. The method of claim 12, wherein in response to the lower-pressure sub-system rail pressure being greater than a fourth threshold over a fourth predetermined time, the fuel system is first adjusted to temporarily further reduce fuel rail pressure in the higher-pressure fuel sub-system and the zero slope analysis is conducted.

15. The method of claim 1, wherein the pressure limiting valve includes a needle which blocks an opening of the pressure limiting valve, the needle held in place by a biasing spring force, the biasing spring force overcome during a condition of excess pressure in the fuel system, such that the pressure limiting valve is opened and fuel is redirected to a fuel supply.

16. A method for controlling a fuel system of an engine including a lower-pressure fuel sub-system and a higher-pressure fuel sub-system, with a pressure limiting valve in fluid communication with the higher-pressure fuel sub-system for relieving excess pressure in the higher-pressure fuel sub-system by returning fuel to the lower-pressure fuel sub-system, comprising:

in response to fuel rail pressure in the higher-pressure fuel sub-system falling below a desired operating pressure during engine operation, first adjusting the fuel system to temporarily further reduce fuel rail pressure in the higher-pressure fuel sub-system below a threshold required to close the pressure limiting valve to reset the pressure limiting valve by substantially stopping fuel flow in the higher-pressure fuel sub-system; and then conducting a zero slope analysis, wherein fuel injection from at least one fuel injector is stopped, the zero slope analysis including determining the absolute value of a change in higher-pressure fuel sub-system rail pressure; and then if the zero slope analysis is greater than a first threshold, over a first predetermined time disabling the engine and if the zero slope analysis is less than the first threshold over the first predetermined time, restarting fuel flow without disabling the engine.

17. The method of claim 16, wherein an inlet metering valve is disposed between the lower-pressure fuel sub-system and the higher-pressure fuel sub-system, and first adjusting the fuel system includes restricting a tractive load from the engine and closing the inlet metering valve; and after first adjusting the fuel system, the fuel system is further adjusted by stopping fuel injection from at least one fuel injector in order to conduct the zero slope analysis.

18. The method of claim 16, wherein the higher-pressure fuel sub-system falling below the desired operating pressure during engine operation is determined by, a higher-pressure sub-system fuel rail pressure error being greater than a second threshold over a second predetermined time, the higher-pressure sub-system fuel rail pressure error calculated by subtracting an actual higher-pressure sub-system fuel rail pressure from a reference higher-pressure fuel sub-system fuel rail pressure, a low rail pressure counter being incremented more occurrences than a third threshold over a third predetermined time, and a lower-pressure fuel sub-system rail pressure being greater than a fourth threshold over a fourth predetermined time.

19. The method of claim 16, wherein, if the absolute value of a change in fuel rail pressure is less than the first threshold over the first predetermined time, fuel flow and fuel injection are resumed.

20. The method of claim 18, wherein presence of a malfunction in the higher-pressure fuel sub-system is determined if the low pressure rail counter has been incremented a greater number of occurrences than the third threshold in the third predetermined time, and if the absolute value of the change in the fuel rail pressure is less than the first threshold over the first predetermined time.

21. The method of claim 20, wherein presence of a malfunction in the lower-pressure fuel sub-system is determined if the lower-pressure rail pressure is less than or equal to the fourth threshold over the fourth predetermined time.

22. A powered system comprising a common rail fuel system for an engine, the common rail fuel system including a fuel supply in fluid communication with a low-pressure fuel pump for pumping fuel from the fuel supply, a high-pressure fuel pump, the high-pressure fuel pump receiving fuel from the low-pressure fuel pump and delivering fuel to a fuel rail, at least one fuel injector in fluid communication with the fuel rail for injecting fuel into the engine, a first region upstream of the high-pressure fuel pump substantially defining a lower-pressure sub-system of the common rail fuel system, a second region downstream of the high-pressure fuel pump defining at least part of a higher-pressure sub-system of the common rail fuel system, a first pressure sensor in fluid communication with the higher-pressure sub-system, a second pressure sensor in fluid communication with the lower-pressure sub-system, an inlet metering valve disposed between the low-pressure fuel pump and the high-pressure fuel pump, a pressure limiting valve, the pressure limiting valve disposed between the high-pressure fuel pump and the fuel rail, and an engine control unit, the engine control unit configured to, determine if a higher-pressure sub-system rail pressure error is of greater than a first threshold over a first predetermined time;

determine if a low pressure rail counter has been incremented a greater number of times than a second threshold over a second predetermined time;

determine if a lower-pressure fuel sub-system rail pressure is greater than a third threshold over a third time;

implement a pressure limiting valve resetting routine to close the pressure limiting valve, the pressure limiting valve resetting routine including restricting a tractive load from the engine, and closing the inlet metering valve to stop fuel flow and reduce the higher-pressure sub-system rail pressure below a threshold required to close the pressure limiting valve, the routine to close the pressure limiting valve implemented in response to a first condition, wherein the first condition includes the higher-pressure sub-system rail pressure error being greater than the first threshold over the first predetermined time, the low pressure rail counter being incremented a greater number of times than the second threshold over the second predetermined time, and the lower-pressure fuel sub-system rail pressure being greater than the third threshold over the third time;

stop fuel injection from at least one fuel injector and determine if an absolute value of a change in fuel rail pressure is greater than a fourth threshold over a fourth time;

restart fuel flow by at least partially opening the inlet metering valve, restarting the at least one fuel injector, and applying the tractive load to the engine after implementing the routine to close the pressure limiting valve after implementing the pressure limiting valve resetting routine in response to a second condition, the second condition comprising the absolute value of the change in fuel rail pressure being less than the fourth threshold over the fourth time;

disable the engine, in response to a third condition, the third condition comprising the absolute value of the change in fuel rail pressure being greater than the fourth threshold over the fourth time after implementing the pressure limiting valve resetting routine and restarting fuel flow;

log a first fault of a leak in the higher-pressure fuel sub-system if the low pressure rail counter has been incremented a greater number of times than the second threshold over the second predetermined time, and if the absolute value of the change in fuel rail pressure is greater than the fourth threshold over the fourth time; and log a second fault of a leak in the lower-pressure fuel sub-system if the lower-pressure fuel sub-system rail pressure is greater than the third threshold over the third time.

23. A method for controlling a fuel system of an engine, comprising:

measuring a fuel rail pressure in a higher-pressure fuel sub-system portion of the fuel system, the fuel system comprising the higher-pressure fuel sub-system, a lower-pressure fuel sub-system, and a pressure limiting valve for relieving excess pressure in the higher-pressure fuel sub-system; and if the fuel rail pressure falls below a desired operating pressure during engine operation, reducing the fuel rail pressure below a threshold required to close the pressure limiting valve by stopping fuel flow in the higher-pressure fuel sub-system, responsive to the fuel rail pressure falling below the desired operating pressure, to reset the pressure limiting valve; subsequently, stopping fuel injection to increase the fuel rail pressure; and subsequently, if the fuel rail pressure recovers after resetting the pressure limiting valve, restarting fuel flow and if the fuel rail pressure persists below the desired operating pressure, disabling the engine or generating a warning.

* * * * *

UNITED STATES PATENT AND TRADEMARK OFFICE

CERTIFICATE OF CORRECTION

PATENT NO. : 8,511,275 B2
APPLICATION NO. : 12/896377
DATED : August 20, 2013
INVENTOR(S) : Nistler et al.

It is certified that error appears in the above-identified patent and that said Letters Patent is hereby corrected as shown below:

In the Specification

In Column 7, Line 2, delete "$LRPR_{constant}$" and insert -- $LPRP_{constant}$ --, therefor.

In Column 7, Line 8, delete "$LRPR_{constant}$" and insert -- $LPRP_{constant}$ --, therefor.

In Column 7, Line 48, delete "time" and insert -- $time_7$ --, therefor.

In Column 7, Line 51, delete "1 s" and insert -- 1s --, therefor.

In Column 7, Line 52, delete "$HRPR_{constant}$" and insert -- $HPRP_{constant}$ --, therefor.

In Column 7, Line 58, delete "($HRPR_{error}$" and insert -- ($HPRP_{error}$ --, therefor.

Signed and Sealed this
Twenty-seventh Day of May, 2014

Michelle K. Lee

Michelle K. Lee
*Deputy Director of the United States Patent and Trademark Office*